US009816699B2

(12) United States Patent
Jonas et al.

(10) Patent No.: US 9,816,699 B2
(45) Date of Patent: Nov. 14, 2017

(54) EXHAUST FAN LIGHT MODULE

(71) Applicant: Broan-NuTone LLC, Hartford, WI (US)

(72) Inventors: Kenneth John Jonas, Mequon, WI (US); Corey Scott Jacak, West Bend, WI (US); Benjamin Thorpe Puffer, Hartford, WI (US); Michael J. Aleven, West Bend, WI (US)

(73) Assignee: BROAN-NUTONE LLC, Hartford, WI (US)

( * ) Notice: Subject to any disclaimer, the term of this patent is extended or adjusted under 35 U.S.C. 154(b) by 0 days.

(21) Appl. No.: 14/843,648

(22) Filed: Sep. 2, 2015

(65) Prior Publication Data

US 2016/0069561 A1 Mar. 10, 2016

Related U.S. Application Data

(60) Provisional application No. 62/046,689, filed on Sep. 5, 2014, provisional application No. 62/101,825, filed on Jan. 9, 2015.

(51) Int. Cl.

| | |
|---|---|
| ***F21V 33/00*** | (2006.01) |
| ***F21V 29/83*** | (2015.01) |
| ***F21V 15/01*** | (2006.01) |
| ***F21V 23/00*** | (2015.01) |
| ***F24F 13/078*** | (2006.01) |

(52) U.S. Cl.

CPC ..... *F21V 33/0096* (2013.01); *F21V 15/01* (2013.01); *F21V 23/001* (2013.01); *F21V 29/83* (2015.01); *F24F 13/078* (2013.01)

(58) Field of Classification Search

CPC ..... F21V 33/0096; F21V 29/83; F21V 15/01; F21V 23/001; F24F 13/078

USPC ..... 362/96

See application file for complete search history.

(56) References Cited

U.S. PATENT DOCUMENTS

| | | | | |
|---|---|---|---|---|
| 2,189,008 | A * | 2/1940 | Kurth | F21V 33/0088 362/294 |
| 3,701,895 | A * | 10/1972 | Sweetser | F21S 8/02 362/264 |
| 3,785,271 | A * | 1/1974 | Joy | F24F 13/078 219/220 |
| 7,203,416 | B2 * | 4/2007 | Craw | F24H 3/0411 392/350 |
| 7,455,432 | B2 * | 11/2008 | Craw | F21V 29/02 362/149 |
| 8,066,802 | B2 | 11/2011 | Kristensson et al. | |
| 8,439,532 | B2 | 5/2013 | Bertram | |
| 8,591,066 | B2 | 11/2013 | Garcia et al. | |
| D705,417 | S * | 5/2014 | Lin | D23/371 |
| 8,992,035 | B2 | 3/2015 | Zhong et al. | |
| 9,103,104 | B1 * | 8/2015 | Tom | E03D 9/052 |
| 2006/0285310 | A1 | 12/2006 | Shyu | |

(Continued)

FOREIGN PATENT DOCUMENTS

CN 105402700 A 3/2016

*Primary Examiner* — Bryon T Gyllstrom

(74) *Attorney, Agent, or Firm* — McDermott Will & Emery LLP

(57) ABSTRACT

A lighting module having at least a semitransparent cover and at least one light emitting diode oriented to emit light through the semitransparent cover. Each light emitting diode is positioned a minimum distance from an inner surface of the semitransparent cover.

20 Claims, 28 Drawing Sheets

(56) References Cited

U.S. PATENT DOCUMENTS

| | | | | |
|---|---|---|---|---|
| 2008/0285271 | A1* | 11/2008 | Roberge | F21S 8/033 362/235 |
| 2009/0170421 | A1* | 7/2009 | Adrian | F24F 7/06 454/349 |
| 2010/0009621 | A1* | 1/2010 | Hsieh | F21V 33/0096 454/293 |
| 2012/0087132 | A1* | 4/2012 | Zakula | F21S 8/026 362/294 |
| 2013/0088855 | A1* | 4/2013 | Ye | F21V 33/0096 362/96 |
| 2013/0343052 | A1 | 12/2013 | Yen | |
| 2014/0043834 | A1 | 2/2014 | Scott | |

* cited by examiner

EXHAUST FAN LIGHT MODULE

CLAIM OF PRIORITY

This patent application claims the benefit of priority, under 35 U.S.C. Section 119(e), to Kenneth J. Jonas et al., U.S. Patent Application Ser. No. 62/046,689, entitled "EXHAUST FAN LIGHT MODULE," filed on Sep. 5, 2014, and under 35 U.S.C. Section 119(e), to Kenneth J. Jonas et al., U.S. Patent Application Ser. No. 62/101,825, entitled "EXHAUST FAN LIGHT MODULE," filed on Jan. 9, 2015, the benefit of priority of which is claimed hereby, and each of which are incorporated by reference herein in its entirety.

TECHNICAL FIELD

This document pertains generally, but not by way of limitation, to a light module for exhaust fan systems.

BACKGROUND

Exhaust fan assemblies for commercial and residential applications often include a fan positioned in a housing in set within the ceiling to draw air through an opening in the ceiling. A grille is typically positioned over the opening to cover the opening and conceal the fan to provide a more aesthetically appealing appearance. A light fixture is often positioned within the housing between the fan and the grille to direct light through the grille or window positioned in the grille. The drawback of the light fixture is that the features of the light fixture can occupy space within the housing disrupting the airflow through the grille to the fan reducing the effectiveness of the exhaust fan.

Incandescent light bulbs can generate a substantial amount of heat requiring substantial air circulation around the light bulb to avoid overheating of the light fixture. Accordingly, incandescent light bulbs are often positioned within a housing to provide the substantial empty space for air circulation around the light bulb. However, the housing can occupy a substantial space within the light fixture further disrupting the airflow through the exhaust fan.

In addition, the light fixture frequently includes a light source that directs the light away from the grille or window against a reflector or other light diffusing mechanism. Orienting the light fixture to emit light directly toward the window or grille can form points of light when viewed through the window. This problem is compounded by the increased use of light emitting diodes ("LEDs"), which often requires the use of a plurality of LEDs to replace a single incandescent light bulb. Similarly, the diffraction of light from the directly oriented light source may be insufficient to illuminate the room. The reflector or diffuser conceals the points of light and improves the diffraction of light from the light source. While the reflector or diffuser improves the effectiveness of the light source, the reflector or diffusor can further disrupt the airflow through the grille and reduce the effectiveness of the exhaust fan.

Overview

The present inventors have recognized, among other things, that a problem to be solved can include providing a light source for an exhaust assembly that does not interfere with the operation of the exhaust assembly. In an example, the present subject matter can provide a solution to this problem, such as by an exhaust fan assembly including a light module containing at least one LED for emitting light through a semitransparent cover. The limited transparency of the cover allows the LEDs to be oriented to directly transmit light through the cover by obscuring the points of light created by the LEDs. In an addition, the LEDs can be positioned at least a minimum distance from an inner surface of the semitransparent cover to permit sufficient space for diffraction of light from the LED.

In an example, the light module can contain at least one incandescent light bulb for emitting light through the semitransparent cover. In this configuration, the cover can include at least one inlet vent for drawing air into the light module to cool the incandescent light bulb. The inlet vent can be positioned adjacent an edge portion of the lens cover to avoid obscuring or refracting the light generated by the light module. In at least one example, the light module can include at least one outlet vent opposite the inlet vent such that air can be drawn into the inlet vent and vented through the outlet vent to circulate air through the light module to avoid overheating of the light module.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
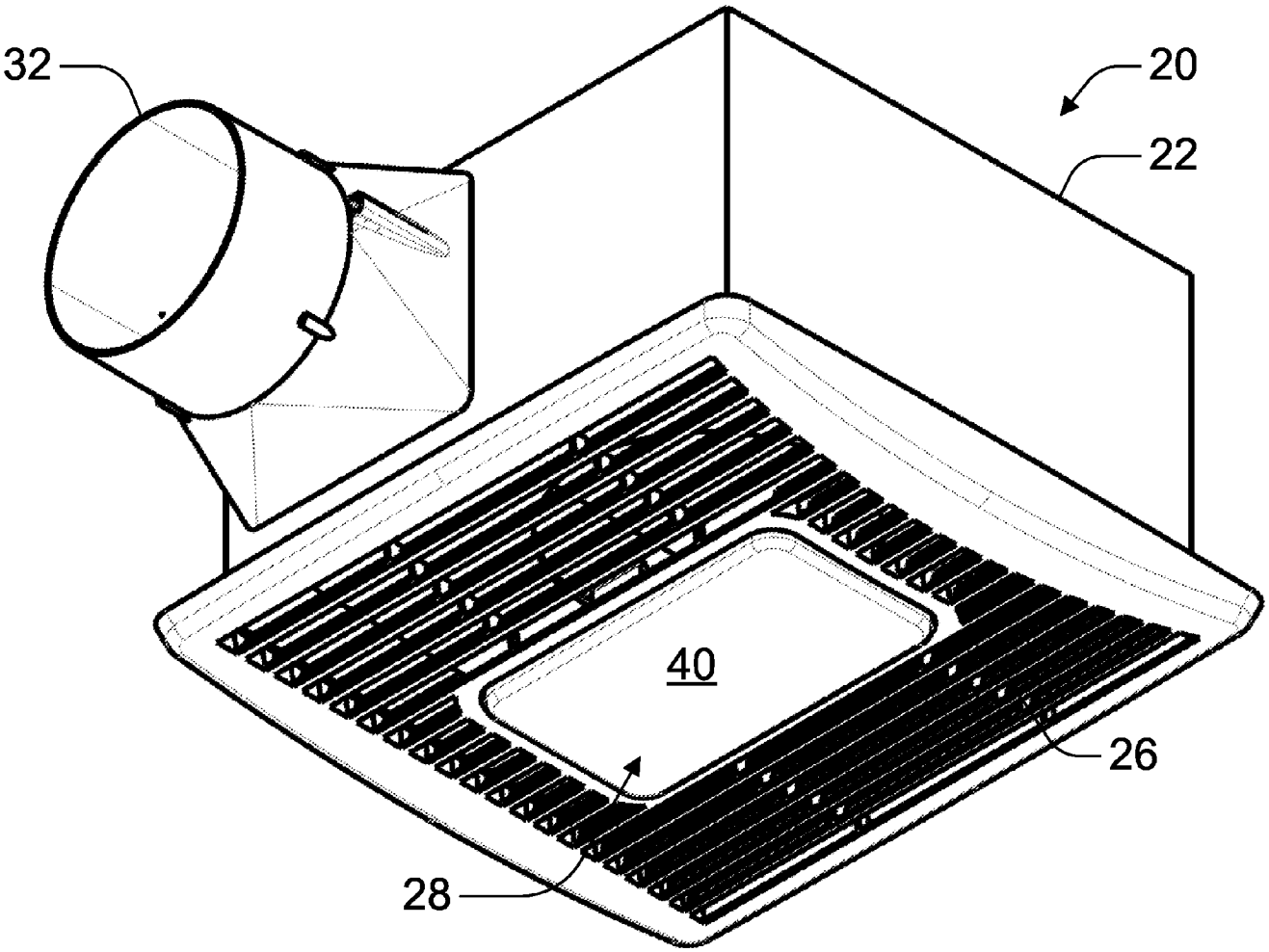
FIG. 1 is a perspective view of an exhaust fan assembly according to an example of the present subject matter.
Figure 2:
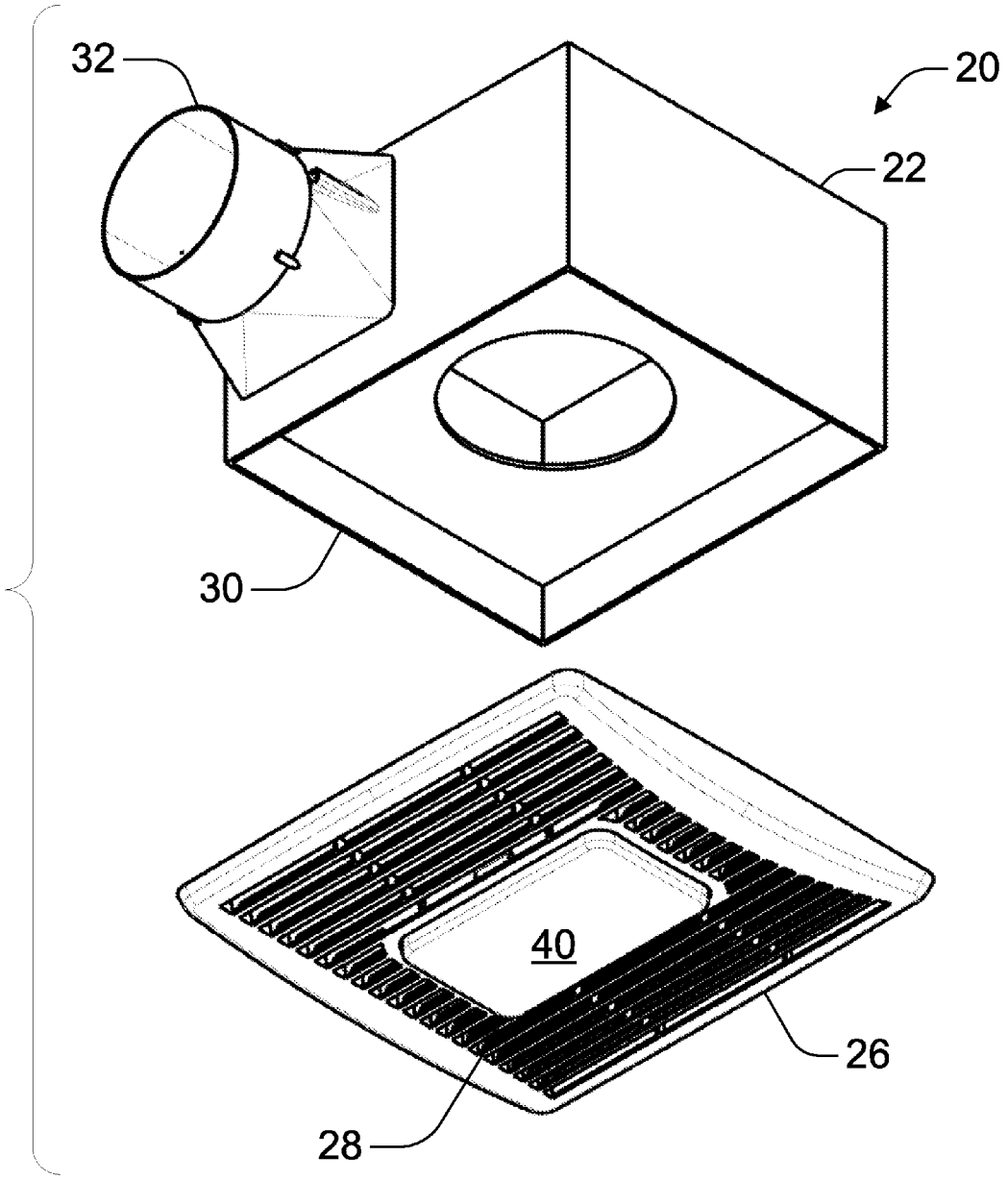
FIG. 2 is an exploded perspective view of the exhaust fan assembly depicted in FIG. 1.
Figure 3:
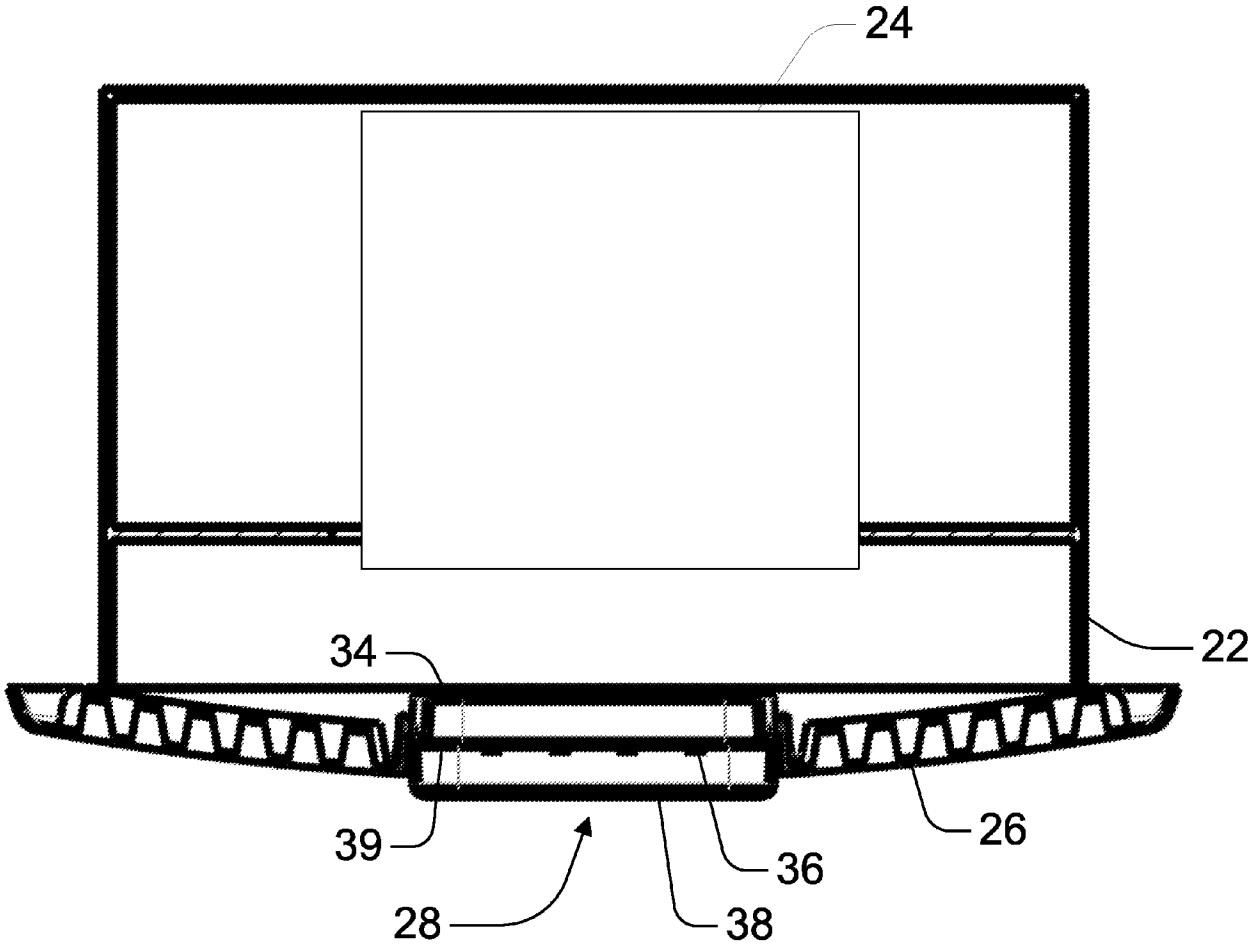
FIG. 3 is a side view of the exhaust fan assembly depicted in FIG. 1.
Figure 4:
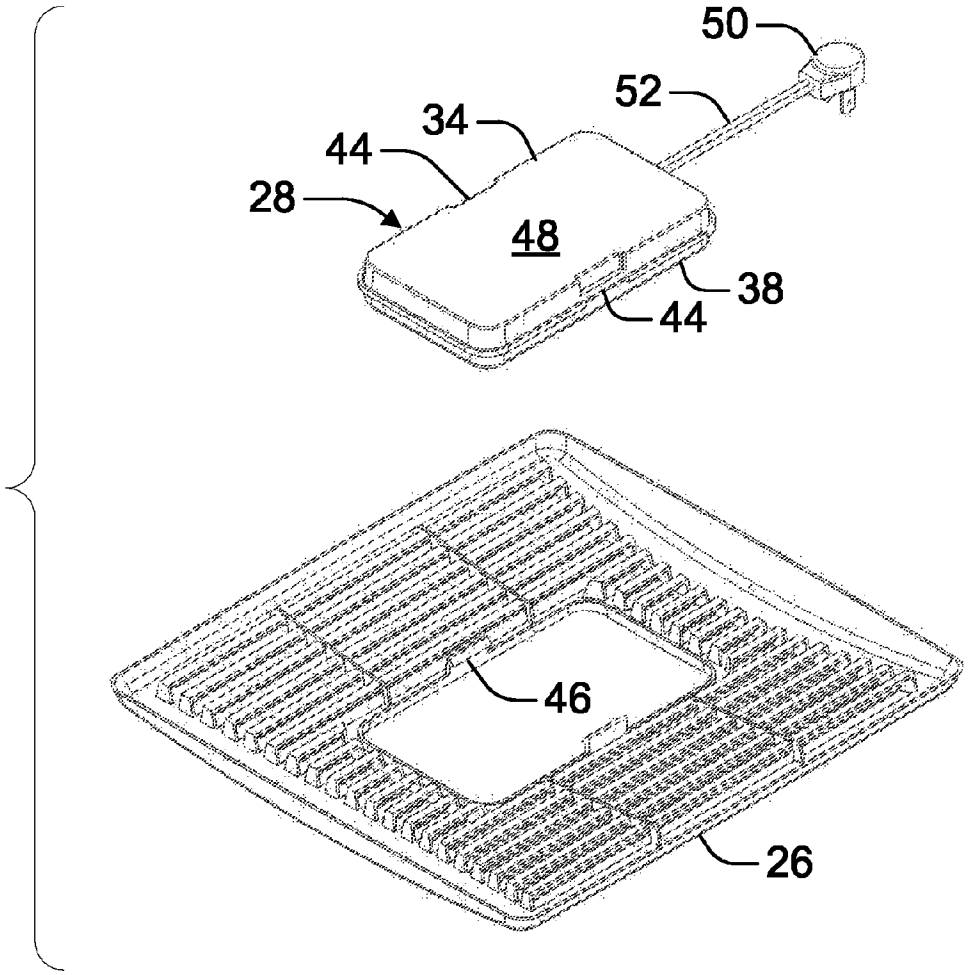
FIG. 4 is an exploded perspective view of a grille and light module assembly according to an example of the present subject matter.
Figure 5:
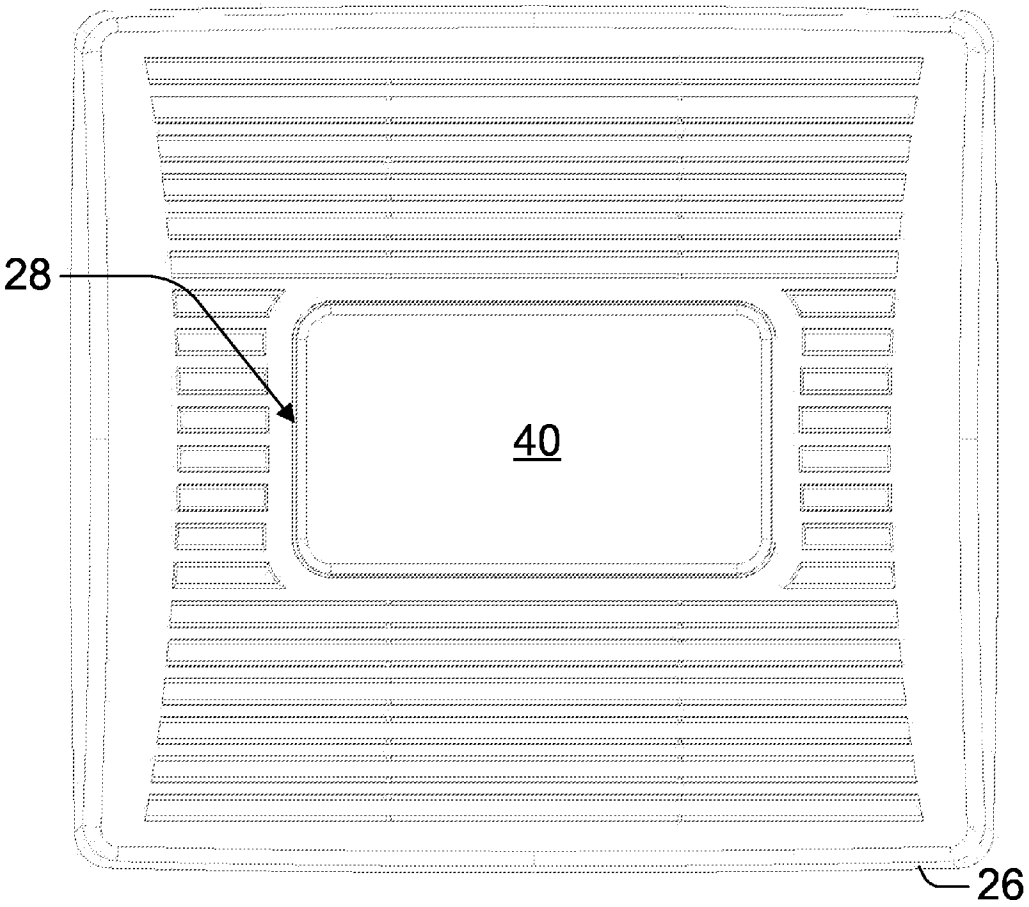
FIG. 5 is a bottom view of the grille and light module assembly depicted in FIG. 4.
Figure 6:
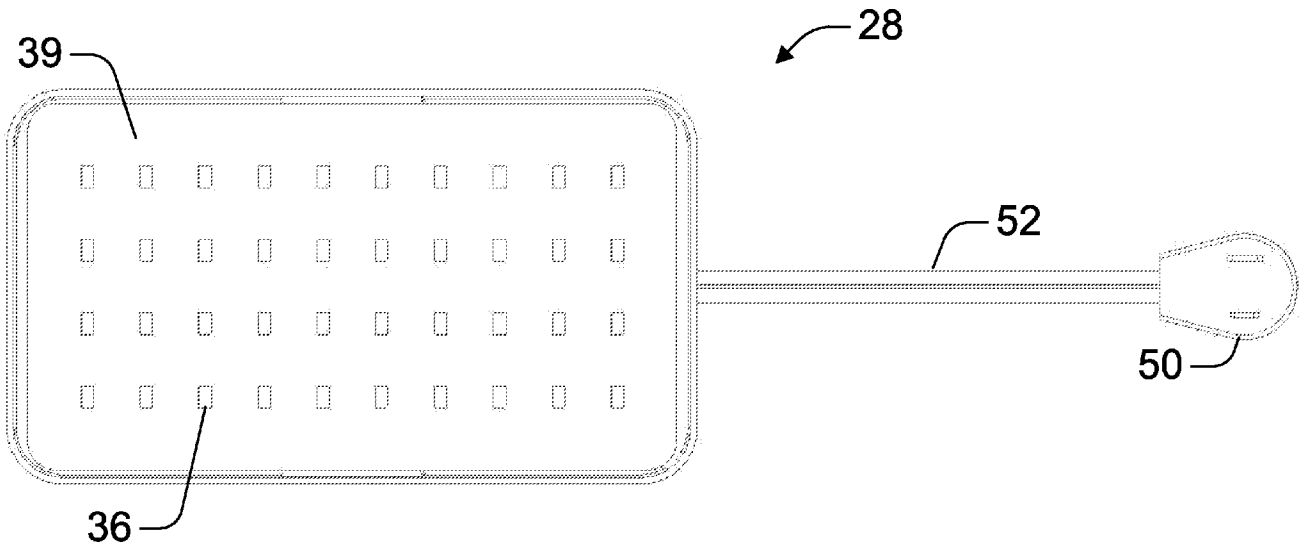
FIG. 6 is a bottom view of a light module assembly according to an example of the present subject matter.
Figure 7:
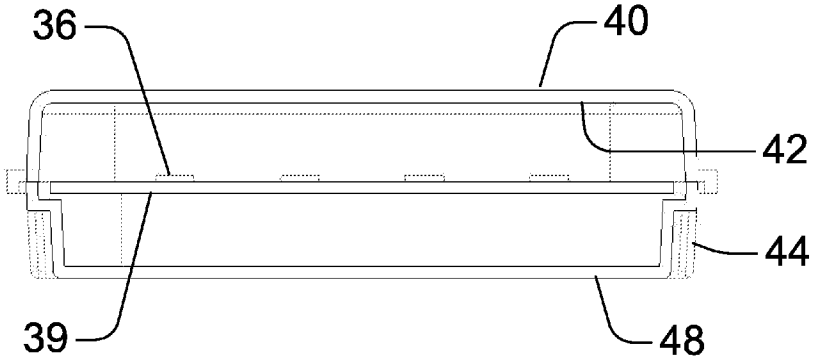
FIG. 7 is a side view of the light module assembly according to an example.
Figure 8:
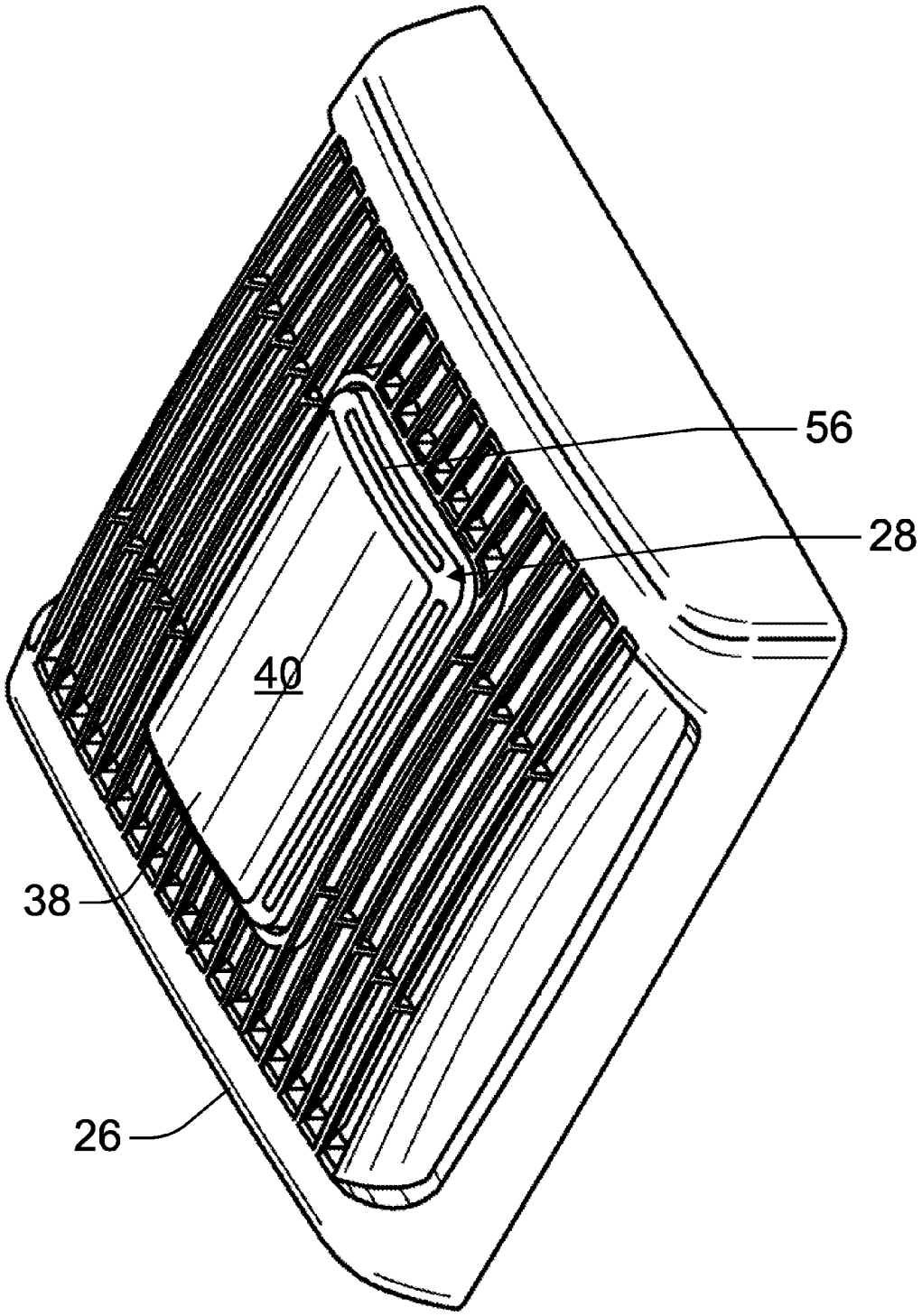
FIG. 8 is a perspective view of a grille and light module assembly according to an example of the present subject matter.
Figure 9:
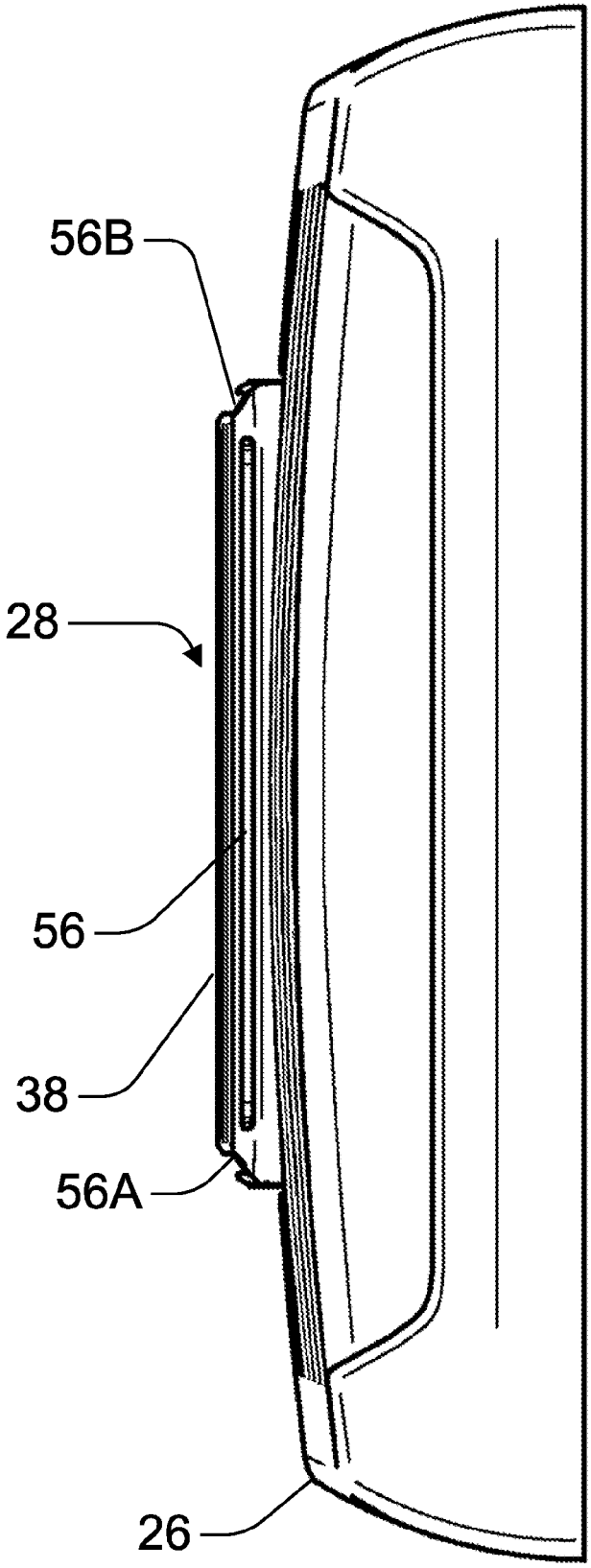
FIG. 9 is a front view of the grille and light module assembly depicted in FIG. 8.
Figure 10:
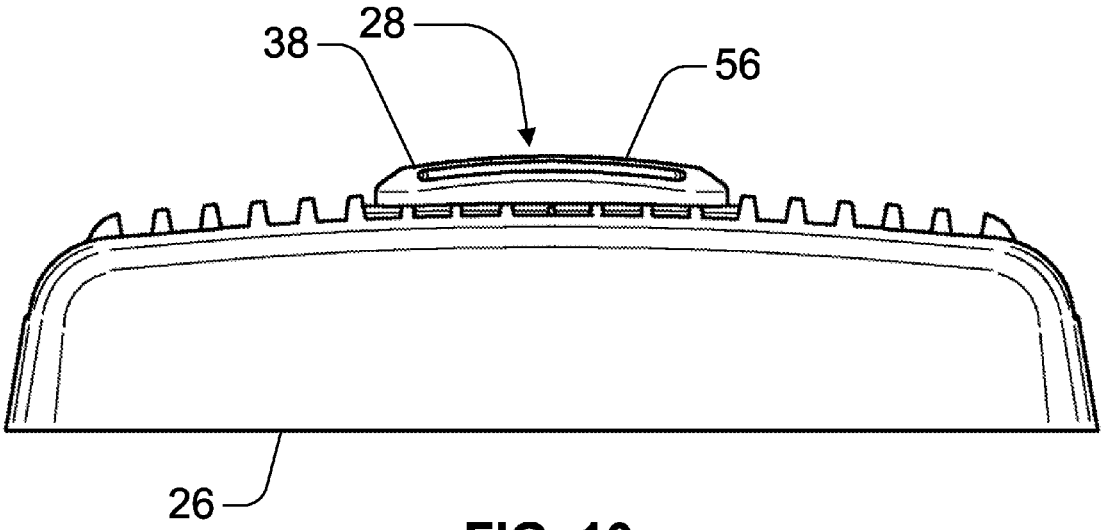
FIG. 10 is a side view of the grille and light module assembly depicted in FIG. 8.
Figure 11:
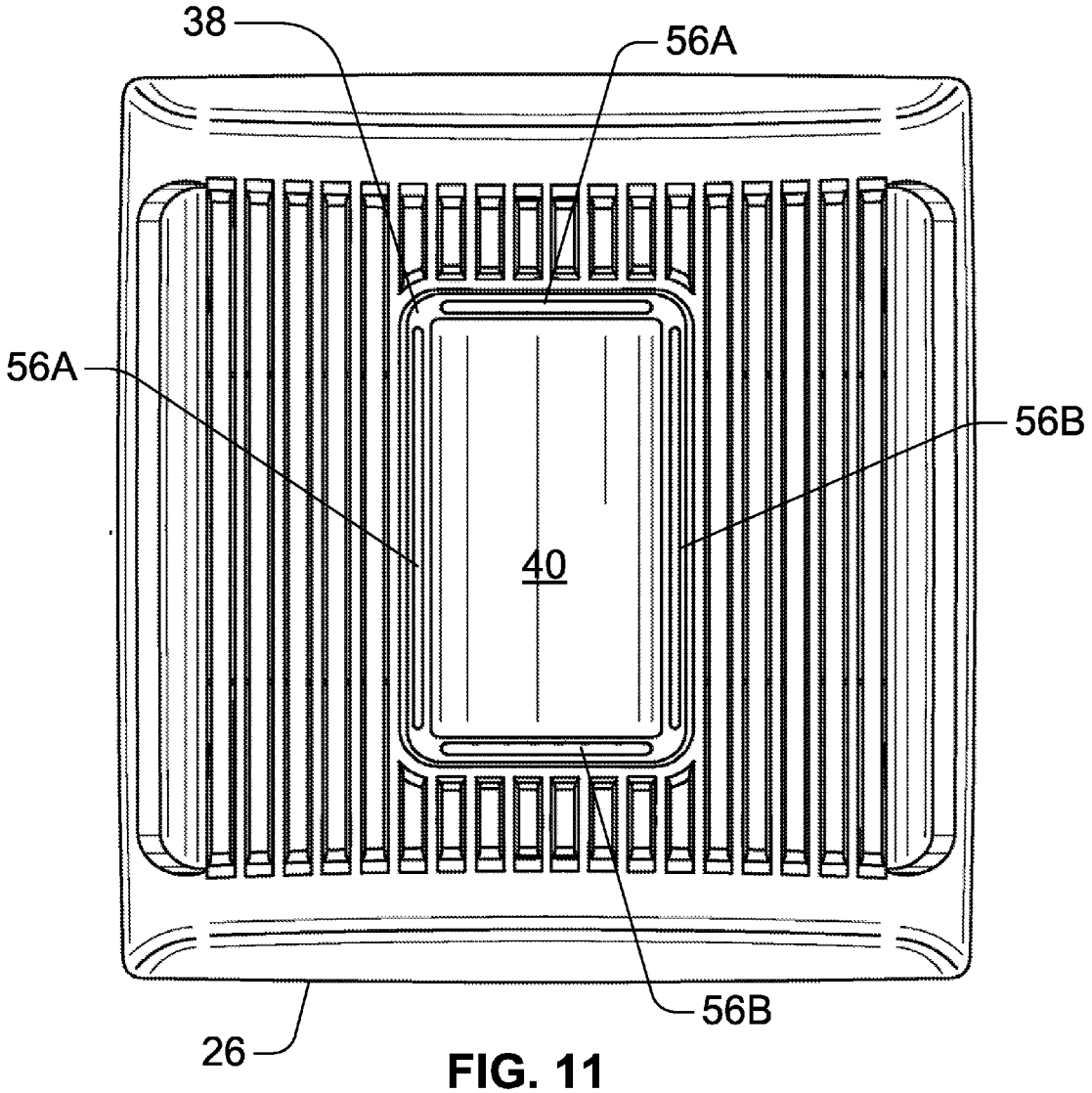
FIG. 11 is a top view of the grille and light module assembly depicted in FIG. 8.
Figure 12:
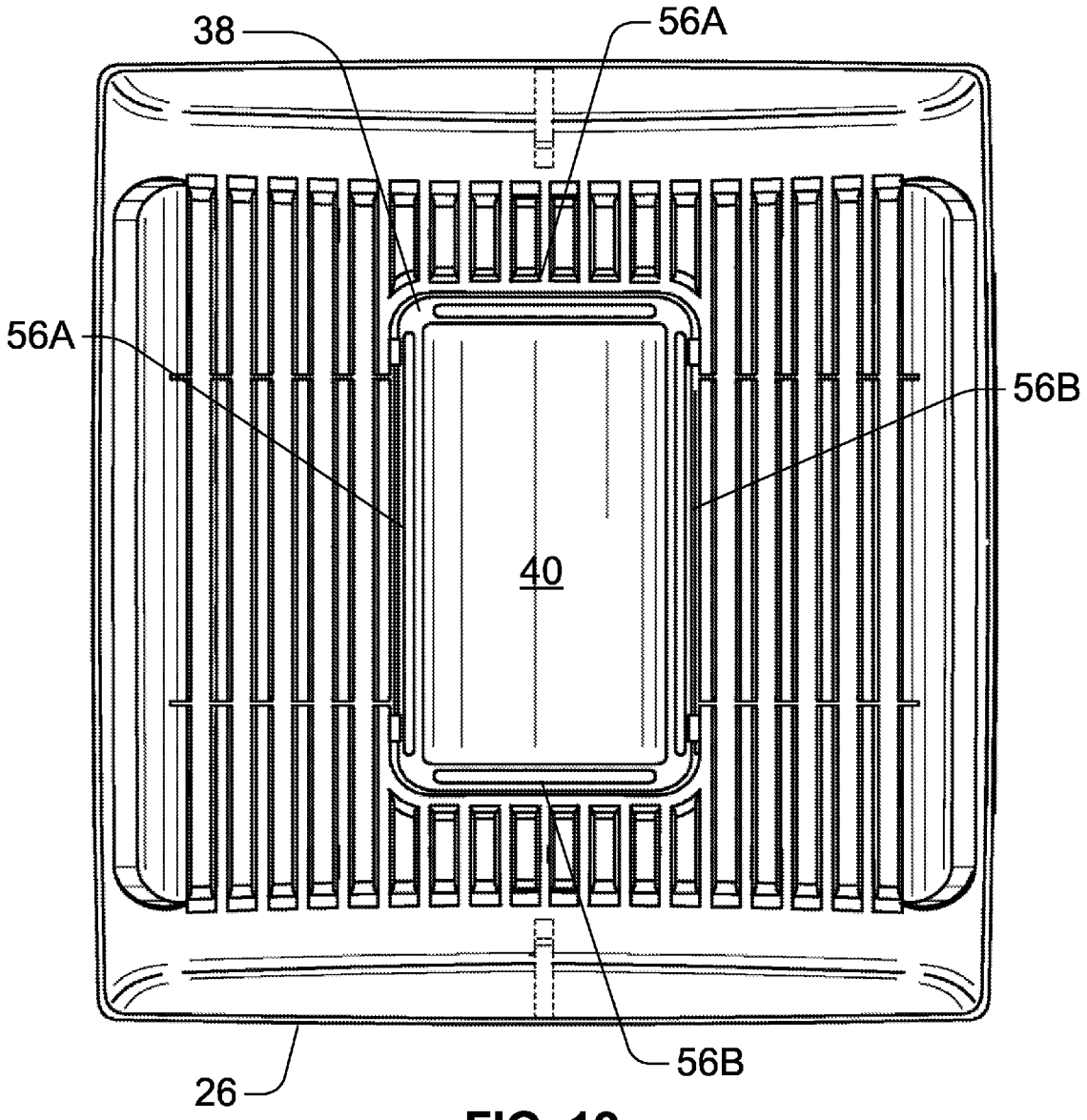
FIG. 12 is a bottom view of the grille and light module assembly depicted in FIG. 8.
Figure 13:
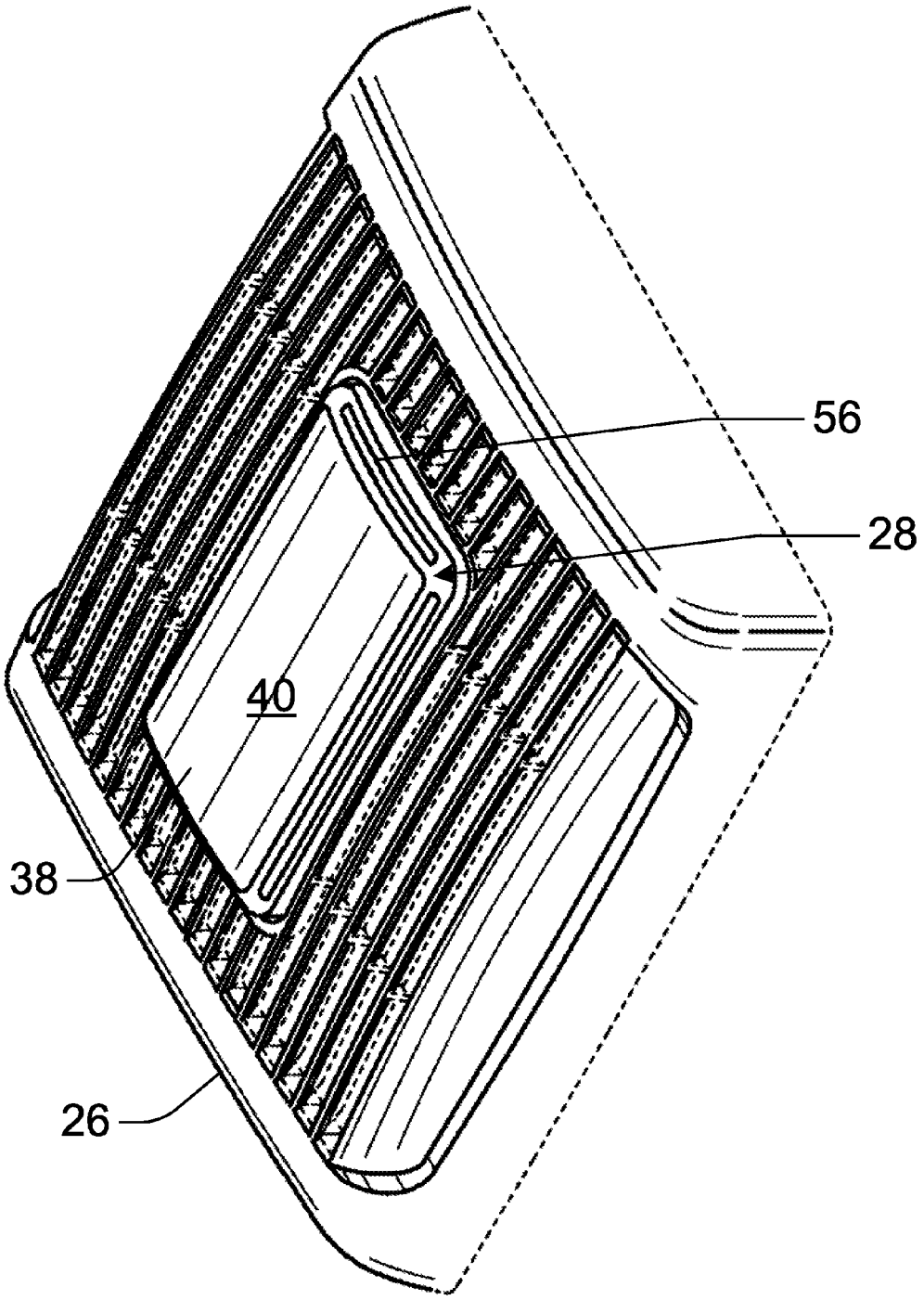
FIG. 13 is a perspective view of a grille and light module assembly according to an example of the present subject matter.
Figure 14:
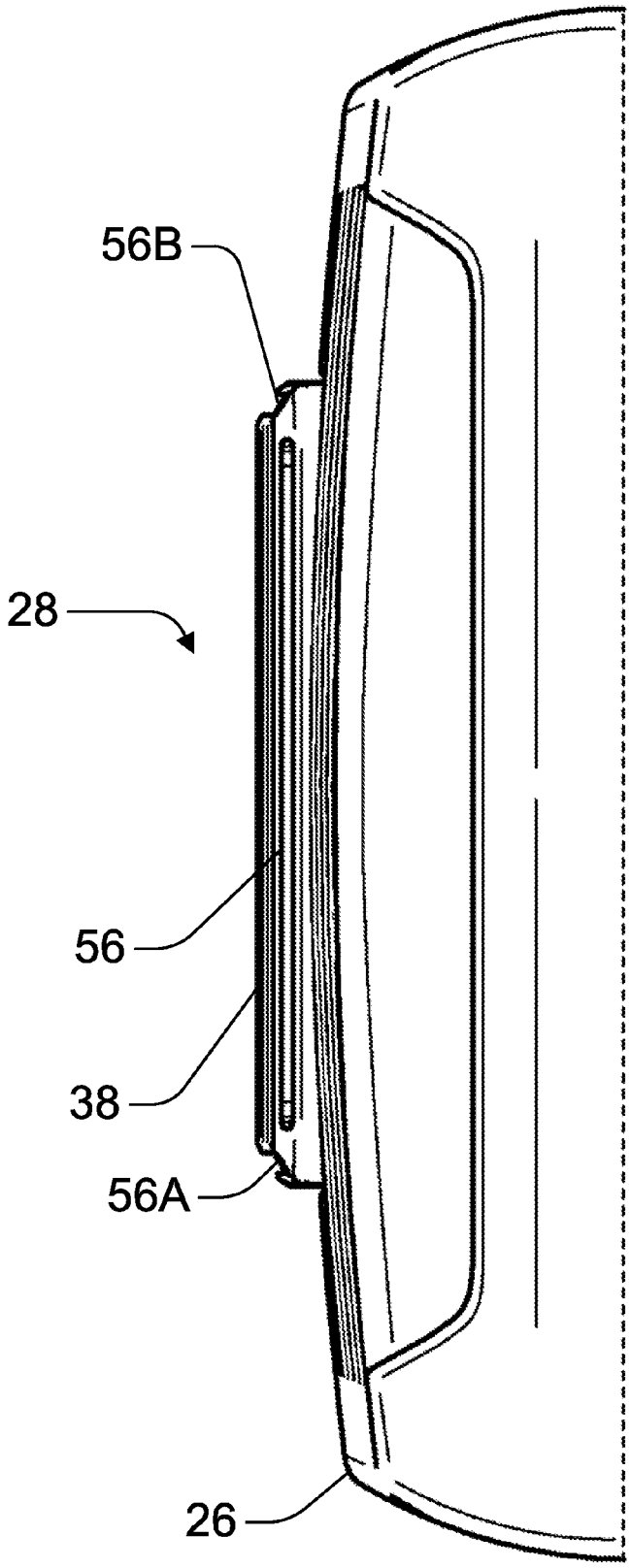
FIG. 14 is a front view of the grille and light module assembly depicted in FIG. 13.
Figure 15:
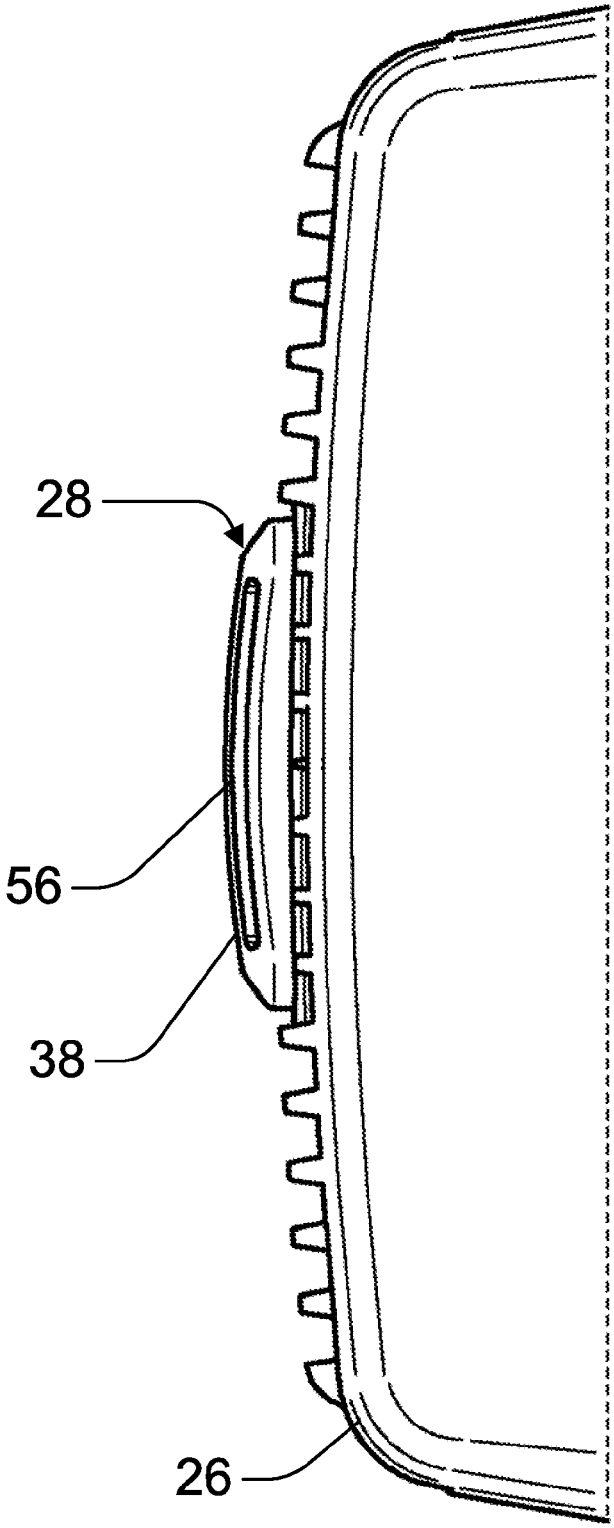
FIG. 15 is a side view of the grille and light module assembly depicted in FIG. 13.
Figure 16:
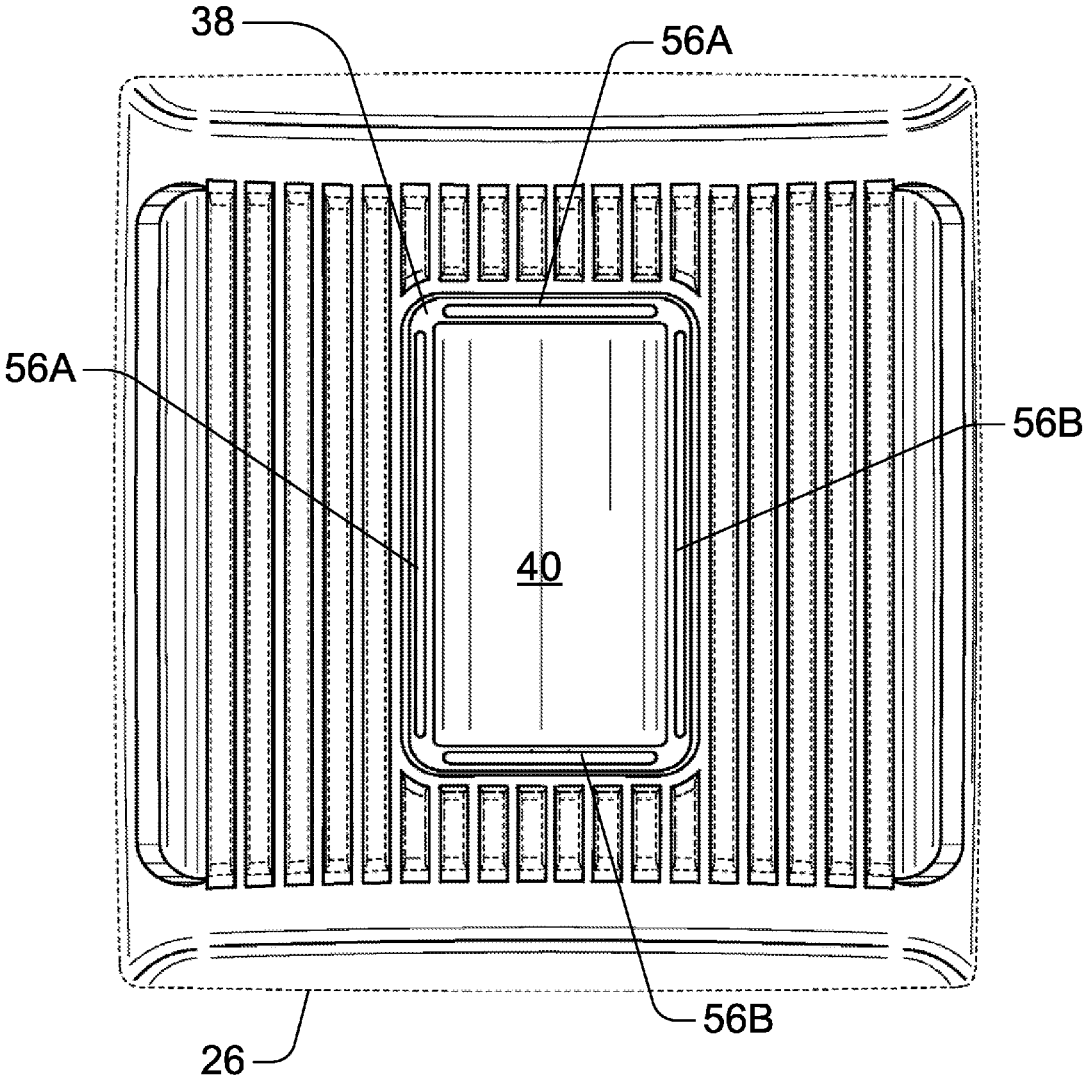
FIG. 16 is a top view of the grille and light module assembly depicted in FIG. 13.
Figure 17:
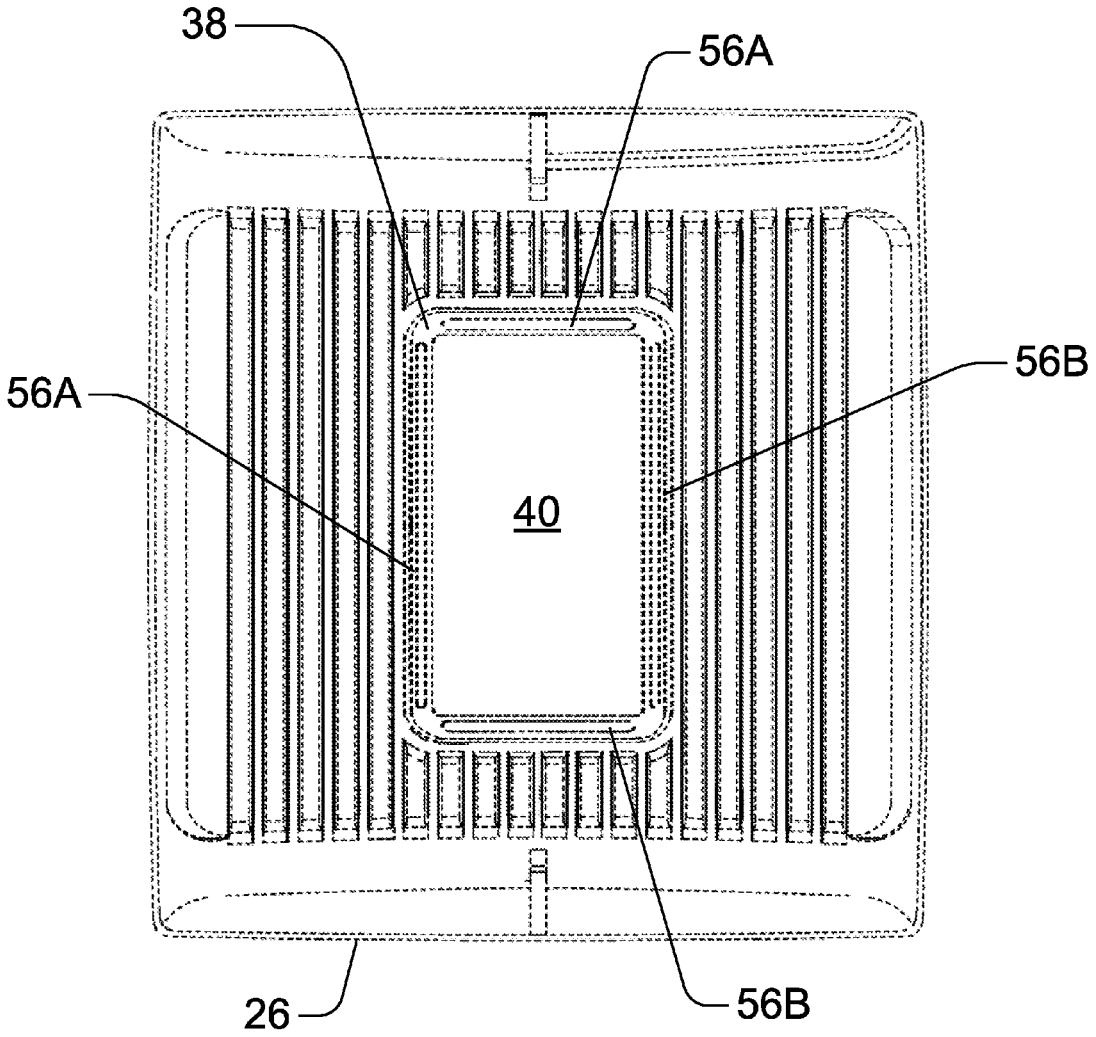
FIG. 17 is a bottom view of the grille and light module assembly depicted in FIG. 13.
Figure 18:
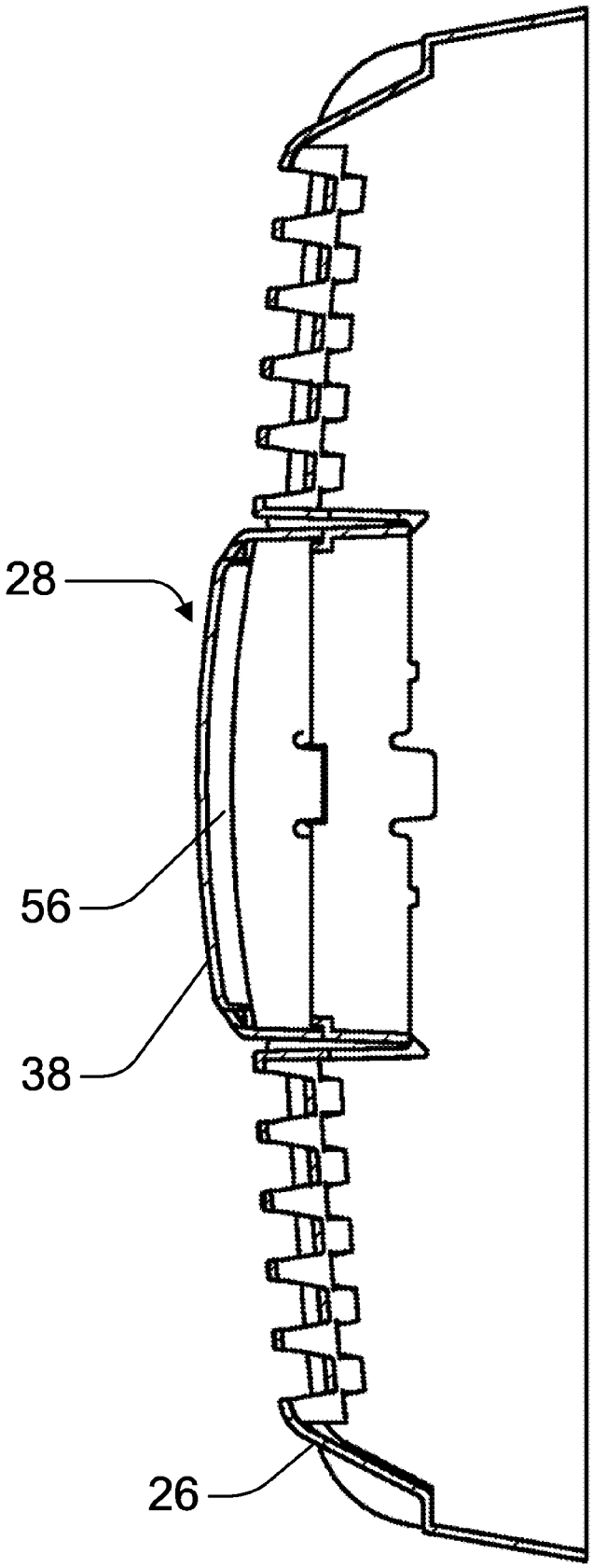
FIG. 18 is a cross-sectional side view of the grille and light module assembly depicted in FIG. 8.
Figure 19:
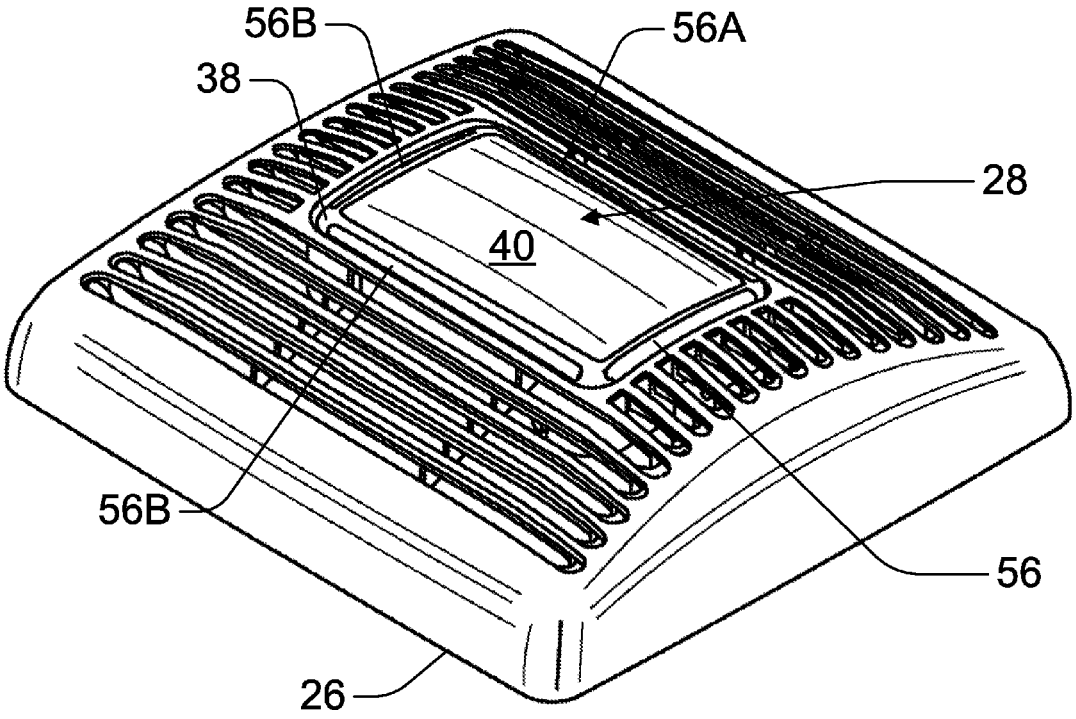
FIG. 19 is a perspective view of a grille and light module assembly according to an example of the present subject matter.
Figure 20:
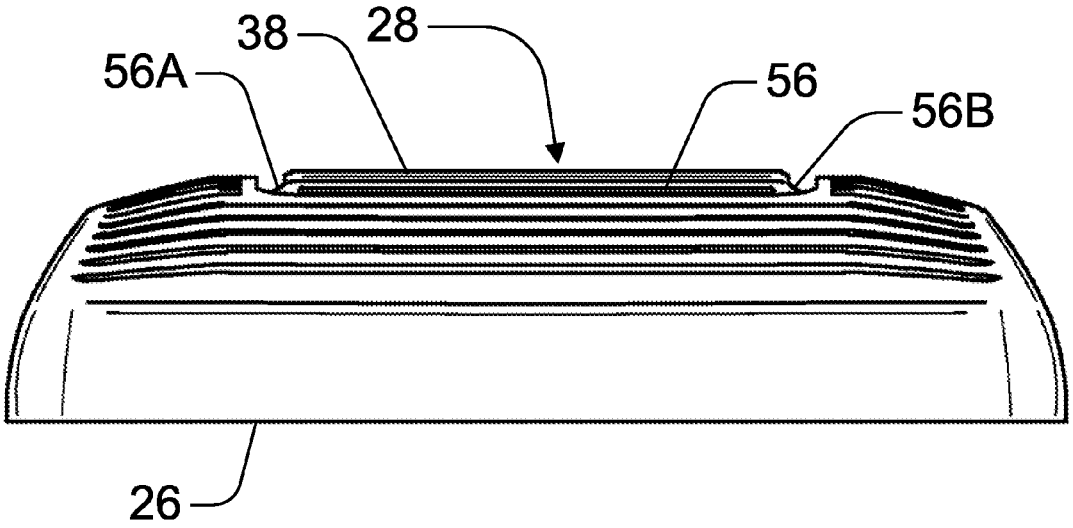
FIG. 20 is a front view of the grille and light module assembly depicted in FIG. 19.
Figure 21:
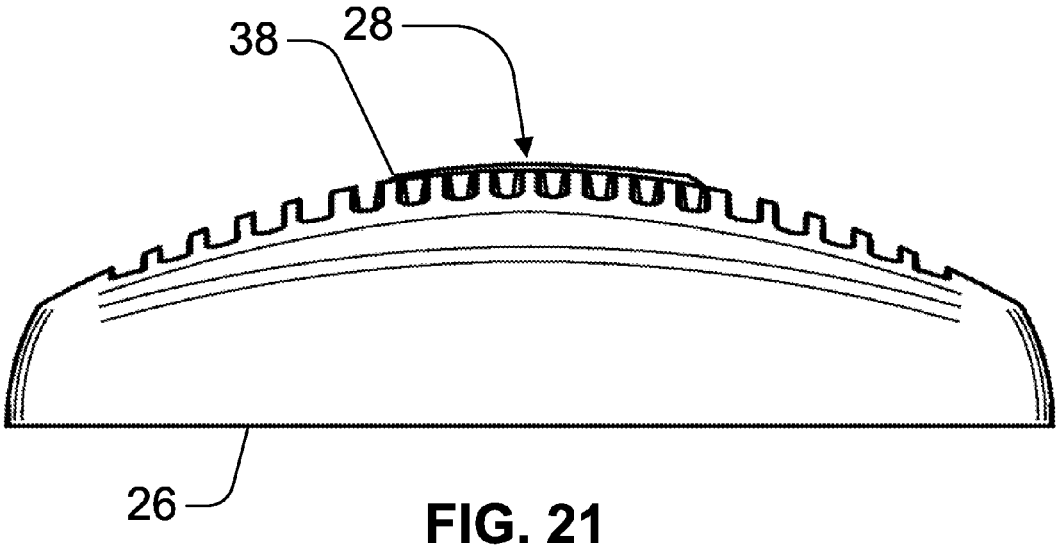
FIG. 21 is a side view of the grille and light module assembly depicted in FIG. 19.
Figure 22:
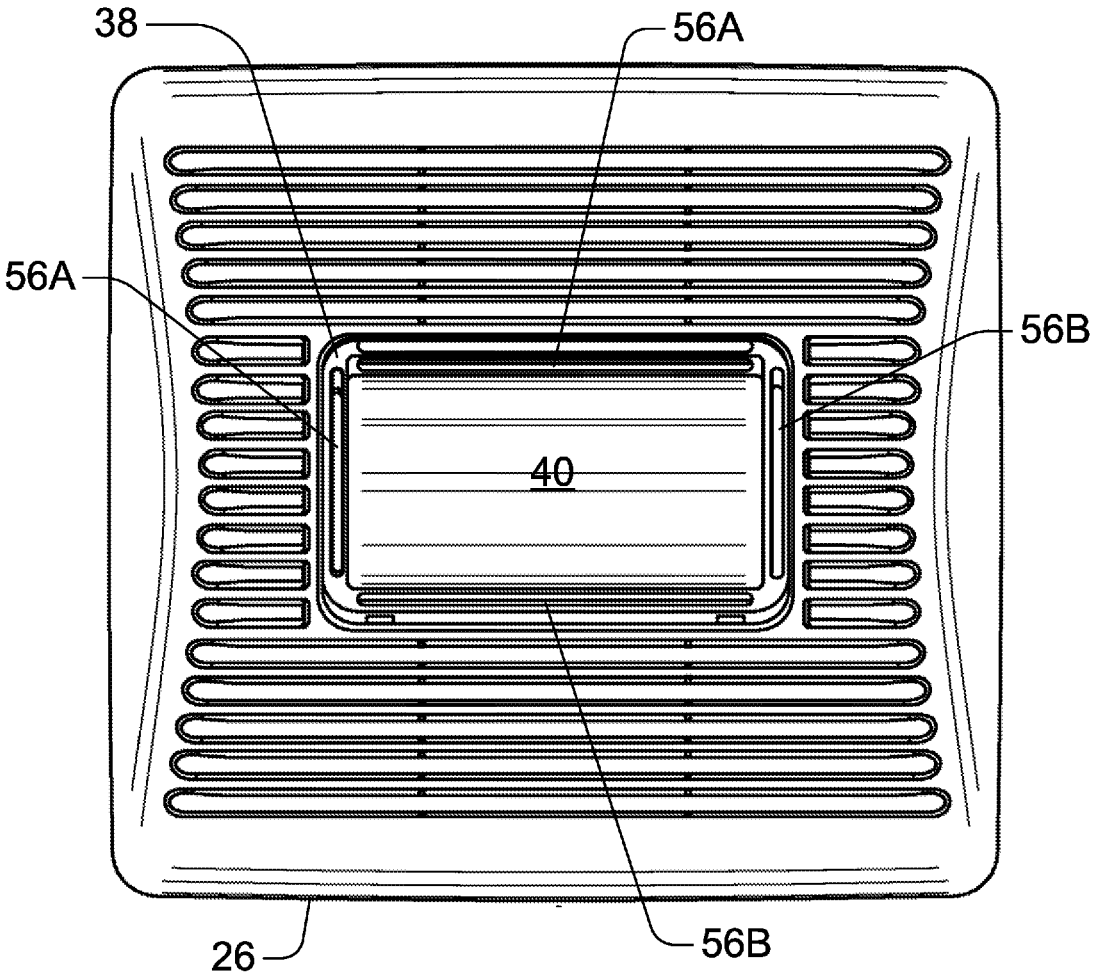
FIG. 22 is a top view of the grille and light module assembly depicted in FIG. 19.
Figure 23:
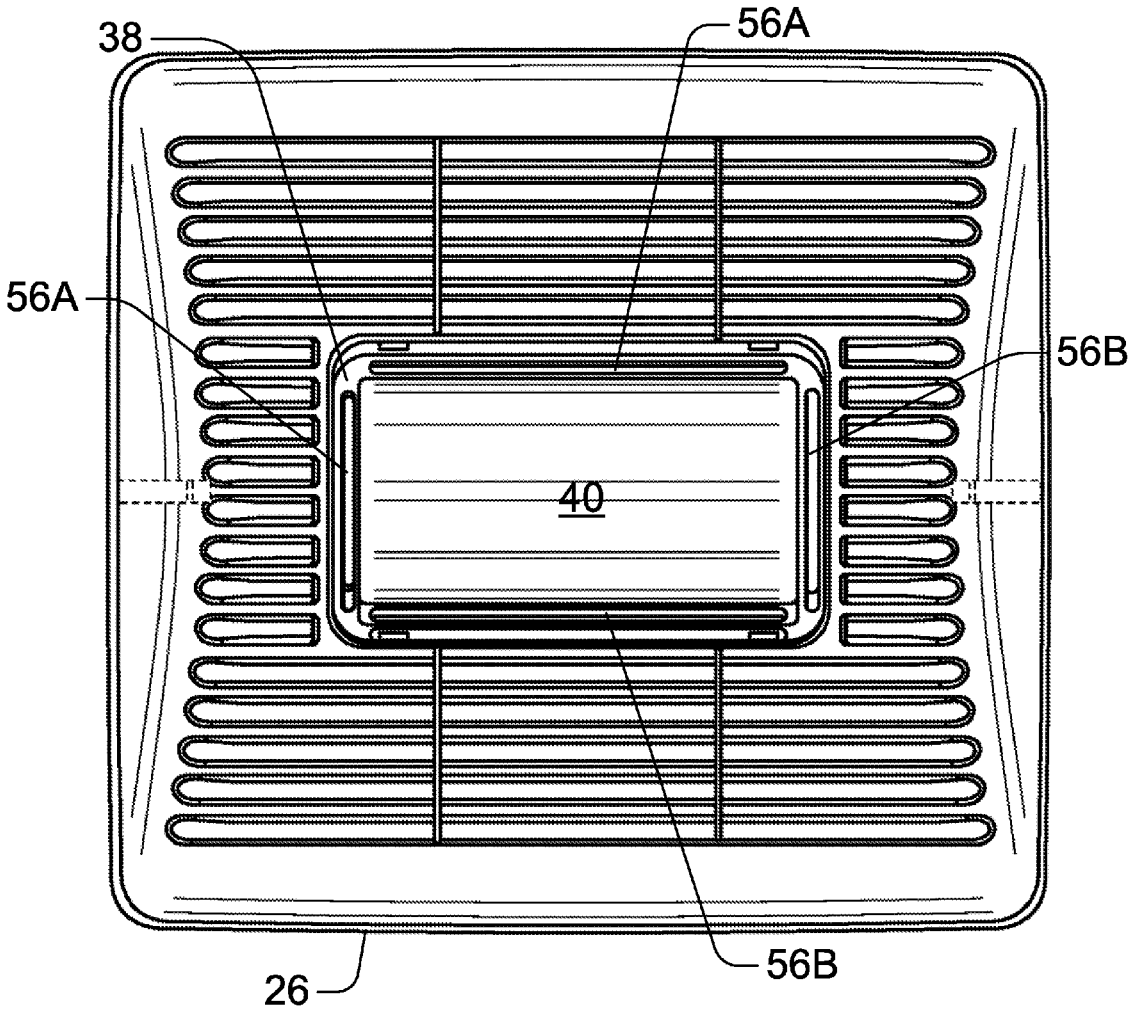
FIG. 23 is a bottom view of the grille and light module assembly depicted in FIG. 19.
Figure 24:
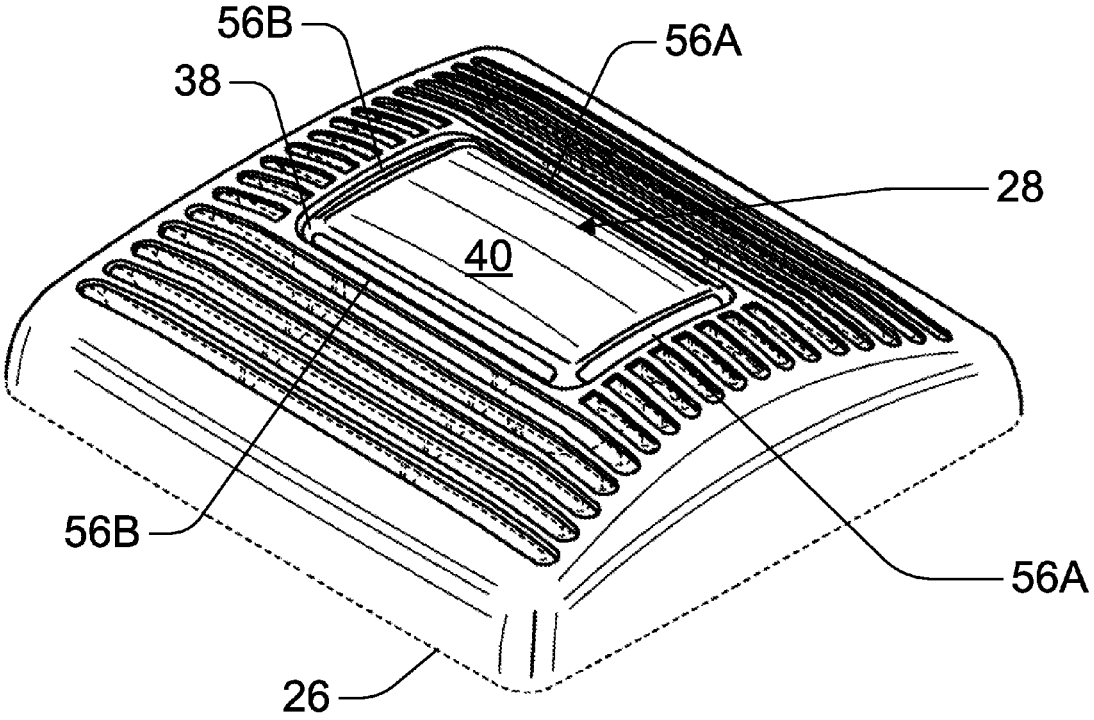
FIG. 24 is a perspective view of a grille and light module assembly according to an example of the present subject matter.
Figure 25:
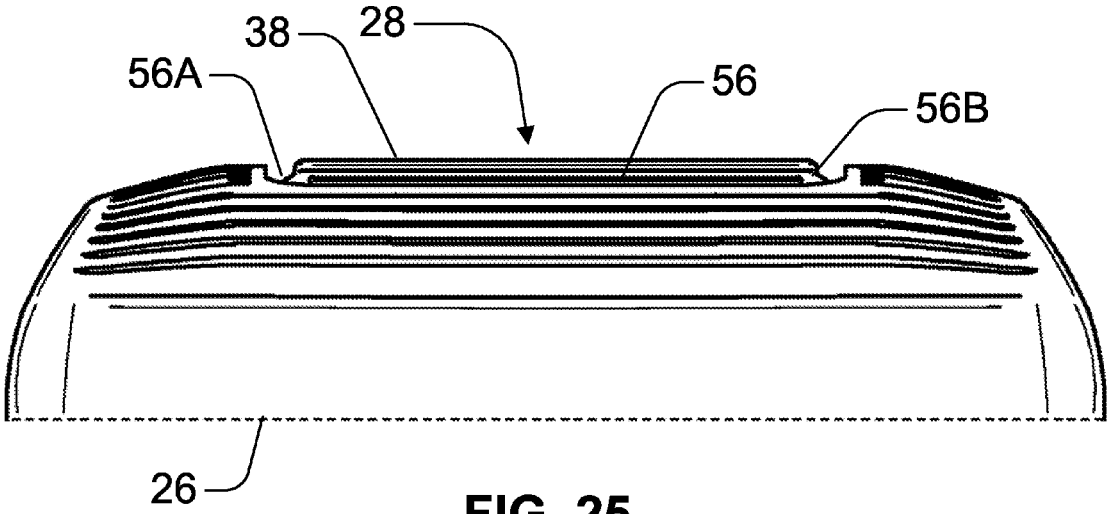
FIG. 25 is a front view of the grille and light module assembly depicted in FIG. 24.
Figure 26:
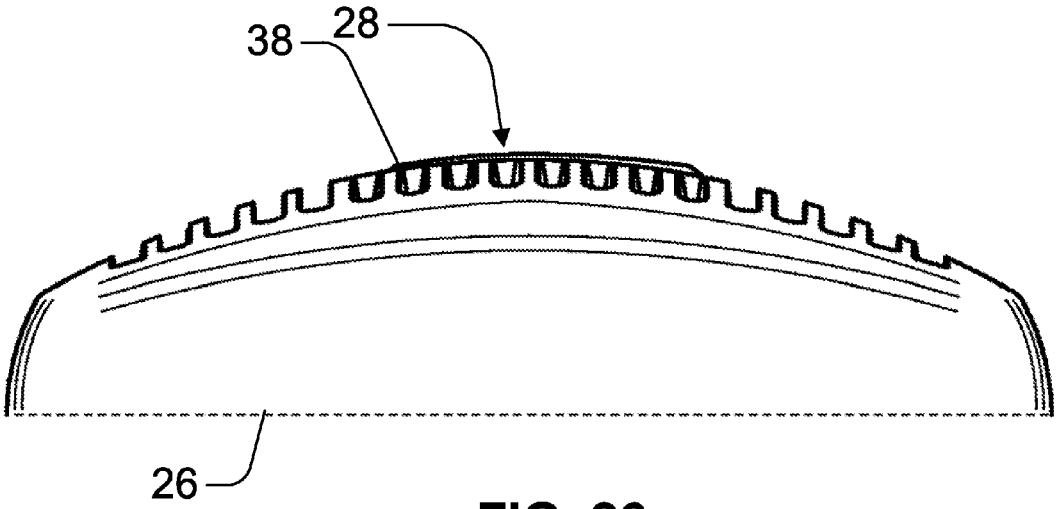
FIG. 26 is a side view of the grille and light module assembly depicted in FIG. 24.
Figure 27:
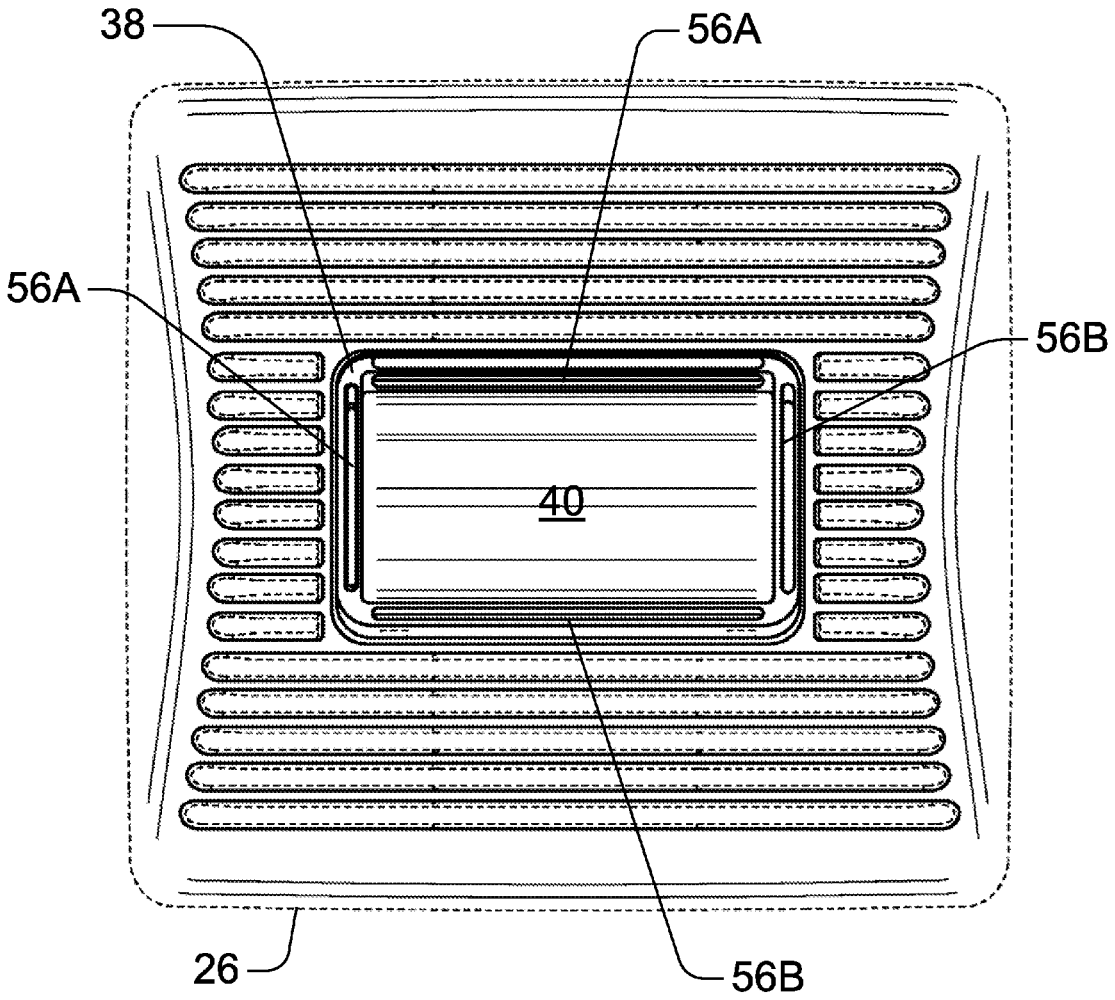
FIG. 27 is a top view of the grille and light module assembly depicted in FIG. 24.
Figure 28:
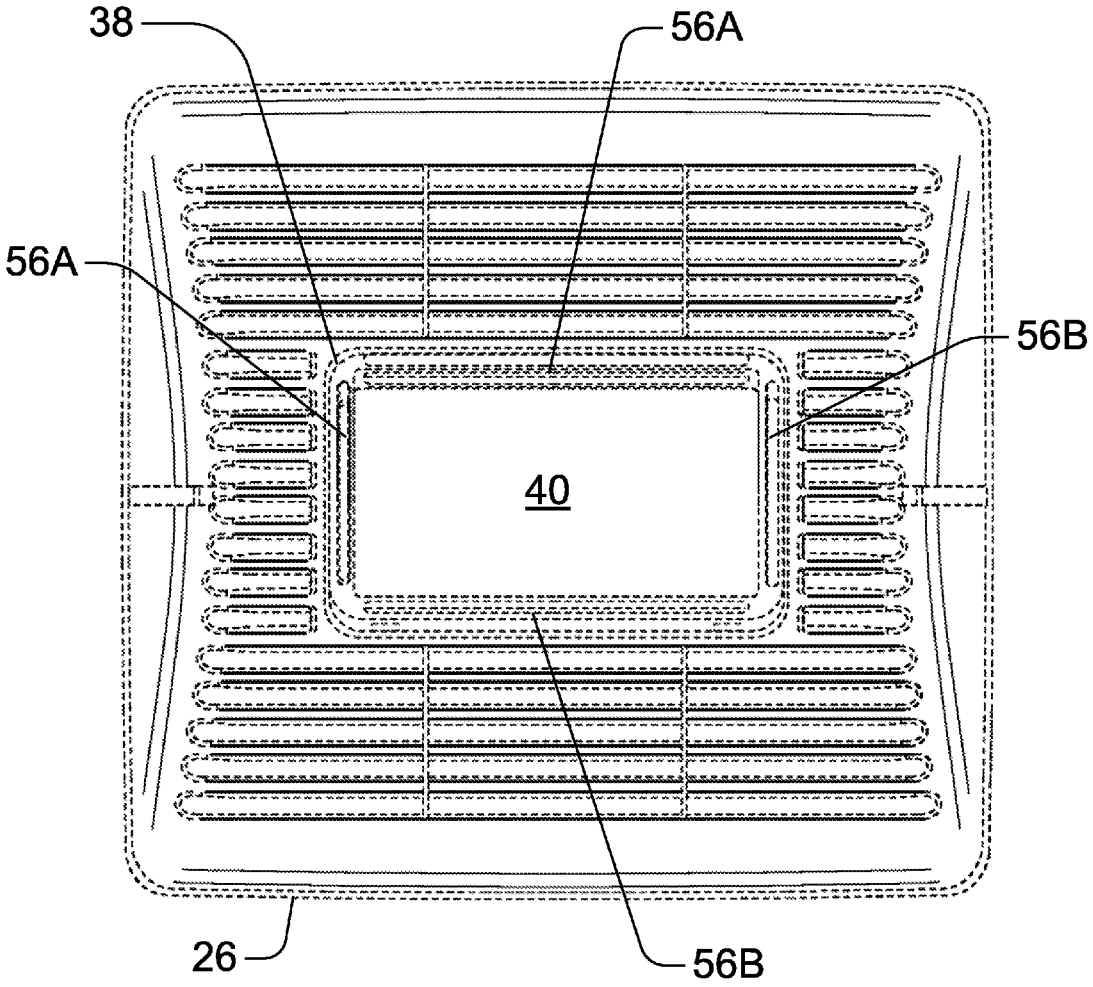
FIG. 28 is a bottom view of the grille and light module assembly depicted in FIG. 24.
Figure 29:
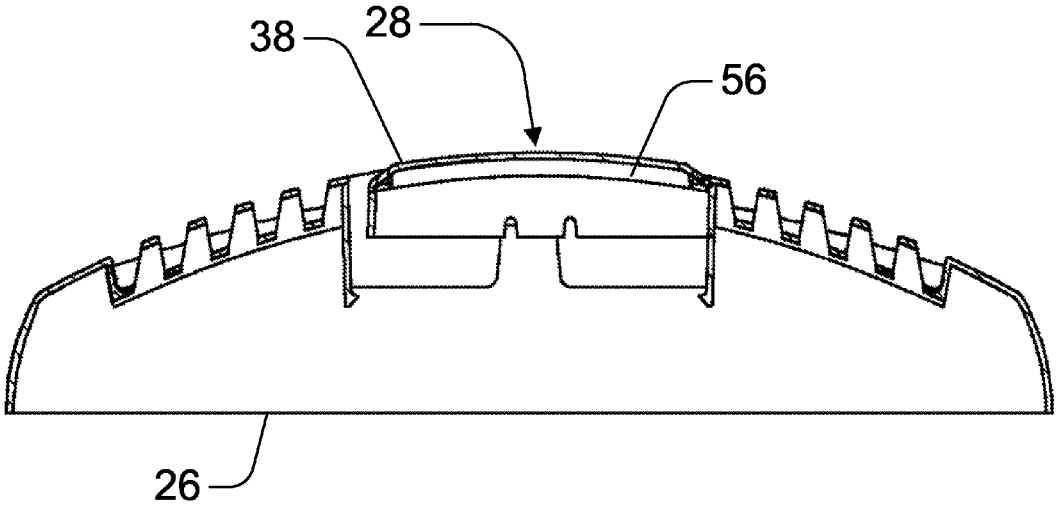
FIG. 29 is a cross-sectional side view of the grille and light module assembly depicted in FIG. 19.

As depicted in FIGS. 1-3, an exhaust fan assembly 20, according to an example, includes a fan housing 22, a fan 24, a grille 26 and a light module 28. The fan housing 22 can define an interior space and an inlet opening 30 and an outlet opening 32. The fan 24 can be positioned within the interior space and operable to draw air through the inlet opening 30 and expel air through the outlet opening 32. In an example, the fan 24 is a rotary fan positioned proximate the outlet opening 32 to increase the interior space between the inlet opening 30 and the fan 24. The grille 26 is positioned within the inlet opening 30 to visually obscure the interior space and the fan 24.

As depicted in FIGS. 1-7, the light module 28, according to an example, can include a module housing 34, at least one light emitting element 36 and a semitransparent cover 38. The module housing 34 can define an interior space for receiving at least one light emitting element 36. The light emitting element 36 can be a light emitting diode, incandescent light bulb or other light emitting device. In an example, a circuit board 39 is positioned within the module housing 34. The circuit board 39 is configured to receive each light emitting element 36 and can position a plurality of light emitting elements 36 in a planar array. The semi-transparent cover 38 is engagable to the module housing 34. In an example, the semitransparent cover 38 is between about 40% and about 80% translucent.

As illustrated in FIGS. 1-7, in an example, the semitransparent cover 38 can include a window portion 40 having an inner surface 42. In certain examples, the each light emitting element 36 is positioned within the module housing 34 such that the light emitting element 36 is at least a minimum predetermined distance. In an example, the minimum predetermined distance can correspond to about the distance between each light emitting element 36 and its adjacent light emitting element 36. In an example, each light emitting element 36 can be equidistance from each light emitting element 36. In an example, each light emitting element 36 can be a first distance from an adjacent light emitting element 36 along a first axis and a second distance from an adjacent light emitting element 36 along a second axis, where the second distance is different from the first distance. In this configuration, in certain examples, the minimum predetermined distance can correspond to the maximum distance between each light emitting element 36 and the adjacent light emitting element 36. In certain examples, the minimum predetermined distance can correspond to the minimum distance between each light emitting element 36 and the adjacent light emitting element 36. The minimum distance improves diffraction of light from the light emitting elements 36.

As depicted in FIGS. 4-7, the grille 26 defines a module opening 44 for receiving the light module 28. In this configuration, the light module 28 can include at least one grille engagement feature 44 for securing the light module 28. Similarly, the grille 26 can include at least one module engagement feature 46 corresponding to the grille engagement feature 44. In an example, the grille engagement features 44 and the module engagement features 46 can be snap in features for tool-less engagement of the light module 28 to the grille 26. In an example, the module housing 34 can include a back surface 48. In certain examples, the light module 28 is mounted on the grille 26 such that the back surface 48 of the module housing 34 is at least a minimum predetermined distance from the fan 24. In an example, the minimum predetermined distance can be up to about 2 inches. The minimum distance between the fan and the back surface 48 of the module housing 34 reduces the interference of the light module 28 on the flow of air through the interior space within the fan housing 22.

As depicted in FIGS. 4-7, the light module 28, according to an example, can further include a connector plug 50 connectable to a wall outlet or other outlet for the house current. In this configuration, the light module 28 can be directly plugged into the house current. Similarly, this arrangement allows the light module 28 to be removed from the grille 26 and replaced with minimal or without tools. The light module 28 can also include a power cable 52 operably connecting the connector plug 50 to the light emitting elements 36. In certain examples, the light module 28 can include a transformer positioned within the module housing 34 or at the connector plug 50 to change the voltage to levels appropriate for the light emitting elements 36.

As depicted in FIGS. 8-29, the semi-transparent cover 38 can have window portion 40 and at least one vent port 56. The window portion 40 can be positioned proximate the center of the cover 38 to correspond the portion where the majority of the light generated by the light emitting element 36 is transmitted through the semi-transparent cover 38. In this configuration, the at least one vent port 56 can be positioned along an edge of the cover 38 to minimize refraction or distortion of the light by the vent port 56.

In an example, each vent port 56 can have depth for creating a pathway to guide the heated air radially outward from the window portion 40. In this configuration, outwardly directed heated air will minimize heat distortion of light transmitted through the lens portion that can be created by the heated air. In at least one example, the heated air stream can be directed to intersect with the air being ventilated through the grille 26 to further dissipate the heat and/or dissipate the heat more quickly.

In an example, the semi-transparent cover 38 can have a plurality of vent ports 56 including at least one inlet vent port 56A and at least one outlet vent port 56B positioned opposite the inlet vent port 56A. In this configuration, air can be drawn into the semi-transparent cover 38 through the inlet vent port 56A and out through the outlet vent port 56B. The circulating air can more rapidly cool the light emitting elements 36 and further dissipate any heated air that can create heat mirages. The designation of the inlet vent port 56A and the outlet vent port 56B are intended to be illustrative and not intended to fix operation of the designated vent port 56 as any vent port 56 can operate as an inlet port or an outlet port depending on the ambient air conditions and the heating conditions within the cover 38. As depicted in FIGS. 8-29, the semi-transparent cover 38 includes two pairs of inlet vent ports 56A and outlet vent ports 56B. It is contemplated that the semi-transparent cover 38 can include a plurality of inlet vent ports 56A and outlet vent ports 56B.

VARIOUS NOTES & EXAMPLES

Example 1 can include subject matter, such as can include a light module 28 for an exhaust fan assembly 20 including a module housing 34; a semitransparent cover 38 coupled to the housing 34 to define an enclosed space; and at least one light emitting element 36 positioned within the housing 34 and oriented to emit light toward the semitransparent cover 38.

Example 2 can include, or can optionally be combined with the subject matter of Example 1, to optionally include that the semitransparent cover 38 including a window portion 40 having an inner surface 42. The light emitting element 36 can be positioned within the interior space a predetermined minimum distance from the inner surface 42 of the window portion 40.

Example 3 can include, or can optionally be combined with the subject matter of Example 2, to optionally include that the semitransparent cover 38 has a sidewall for positioning the inner surface 42 of the window portion 40 the predetermined minimum distance.

Example 4 can include, or can optionally be combined with the subject matter of Example 2, to optionally include that the predetermined minimum distance corresponds to about a spacing distance between two adjacent light emitting elements 36.

Example 5 can include, or can optionally be combined with the subject matter of one or any combination of the preceding claims, to optionally include that the housing 34 further includes at least one mounting feature that can be engaged to a grille 26 of the exhaust fan assembly 20.

Example 6 can include, or can optionally be combined with the subject matter of Example 4, to optionally include that the grille 26 defines an opening for receiving the housing 34.

Example 7 can include, or can optionally be combined with the subject matter of one or any combination of the preceding claims, to optionally include that the light module 28 includes a plurality of light emitting elements 36. The plurality of the light emitting elements 36 can be arranged in an planar array.

Example 8 can include, or can optionally be combined with the subject matter of one or any combination of the preceding claims, to optionally include a power cable 52 connectable to a wall outlet and a connector cable operably connecting the power cable 52 to each light emitting elements 36.

Example 9 can include, or can optionally be combined with the subject matter of one or any combination of the preceding claims, to optionally include that the at least one light emitting element 36 can comprise at least one of a light emitting diode and an incandescent bulb.

Example 10 can include, or can optionally be combined with the subject matter of one or any combination of the preceding claims, to optionally include that the semitransparent cover 38 includes at least one vent port for dissipating heat from within the light module 28.

Example 11 can include subject matter, such as can include an exhaust fan assembly 20 including a fan housing defining an interior space and including an inlet opening and an outlet opening; a fan positioned within the interior space, the fan being operable to draw air through the inlet opening and out the outlet opening; a grille 26 engaged to the fan housing within the inlet opening; and a light module 28. The light module 28 can include a module housing 34 engaged to the grille 26, a semitransparent cover 38 coupled to the housing 34 to define an enclosed space, and at least one light emitting element 36 positioned within the housing 34 and oriented to emit light toward the semitransparent cover 38.

Example 12 can include, or can optionally be combined with the subject matter of Example 11, to optionally include that the module housing 34 includes a rear face.

Example 13 can include, or can optionally be combined with the subject matter of Example 12, to optionally include that the fan is at least up to about 2 inches from the rear face of the module housing 34.

Example 14 can include, or can optionally be combined with the subject matter of one or any combination of the preceding claims, to optionally include that the grille 26 defines a module opening for receiving the light module 28.

Example 15 can include, or can optionally be combined with the subject matter of Example 14, to optionally include that the housing 34 further includes at least one mounting feature can be engaged to a grille 26 of the exhaust fan assembly 20.

Example 16 can include, or can optionally be combined with the subject matter of one or any combination of the preceding claims, to optionally include that the semitransparent cover 38 including a window portion 40 having an inner surface 42. The light emitting element 36 can be positioned within the interior space a predetermined minimum distance from the inner surface 42 of the window portion 40.

Example 17 can include, or can optionally be combined with the subject matter of Example 16, to optionally include that the semitransparent cover 38 having a sidewall for positioning the inner surface 42 of the window portion 40 the predetermined minimum distance.

Example 18 can include, or can optionally be combined with the subject matter of Example 16, to optionally include that the predetermined minimum distance corresponds to about a spacing distance between two adjacent light emitting elements 36.

Example 19 can include, or can optionally be combined with the subject matter of one or any combination of the preceding claims, to optionally include that the light module 28 includes a plurality of light emitting elements 36. The plurality of the light emitting diodes can be arranged in an planar array.

Example 20 can include, or can optionally be combined with the subject matter of one or any combination of the preceding claims, to optionally include a power cable 52 connectable to a wall outlet and a connector cable operably connecting the power cable 52 to each light emitting elements 36.

Example 21 can include, or can optionally be combined with the subject matter of one or any combination of the preceding claims, to optionally include that the at least one light emitting element 36 can comprise at least one of a light emitting diode and an incandescent bulb.

Example 22 can include, or can optionally be combined with the subject matter of one or any combination of the preceding claims, to optionally include that the semitransparent cover 38 includes at least one vent port 56 for dissipating heat from within the light module 28.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. An exhaust fan assembly comprising:

a housing defining an interior space and including an air inlet opening and an air outlet opening;

a grille configured to engaged the fan housing, the grille defining a light module opening; and a light module comprising:

a light module housing;

a semitransparent cover coupled to the light module housing to define an enclosed space; and at least one light emitting element positioned within the light module housing and oriented to emit light toward the semitransparent cover, wherein the grille comprises at least one light module engagement feature and the light module comprises at least one grille engagement feature, and wherein the grille engagement feature and the light module engagement feature each comprise a snap-in feature for tool-less engagement of the light module in the light module opening of the grille.

2. The exhaust fan assembly of claim 1, wherein the semitransparent cover includes a window portion having an inner surface, and wherein the at least one light emitting element is positioned within the interior space a predetermined minimum distance from the inner surface of the window portion.

3. The exhaust fan assembly of claim 2, wherein the semitransparent cover has a sidewall for positioning the inner surface of the window portion the predetermined minimum distance from the at least one light emitting element.

4. The exhaust fan assembly of claim 3, wherein the at least one light emitting element comprises a plurality of light emitting elements, and wherein the predetermined minimum distance corresponds to about a spacing distance between two adjacent light emitting elements of the plurality of light emitting elements.

5. The exhaust fan assembly of claim 4, wherein the predetermined minimum distance corresponds to about a maximum spacing between adjacent light emitting elements of the plurality of light emitting elements.

6. The exhaust fan assembly of claim 4, wherein the predetermined minimum distance corresponds to about a minimum spacing between adjacent light emitting elements of the plurality of light emitting elements.

7. The exhaust fan assembly of claim 1, wherein the light module includes a plurality of light emitting elements, and wherein the plurality of the light emitting elements are arranged in a planar array.

8. The exhaust fan assembly of claim 1, further comprising:

a power cable connectable to a wall outlet; and a connector cable operably connecting the power cable to the at least one light emitting element.

9. The exhaust fan assembly of claim 1, wherein the at least one light emitting element comprises at least one of a light emitting diode and an incandescent bulb.

10. The exhaust fan assembly claim 1, wherein the semitransparent cover includes at least one vent port for dissipating heat from within the light module.

11. An exhaust fan assembly comprising:

a fan housing defining an interior space and including an inlet opening and an outlet opening;

a fan positioned within the interior space, the fan being operable to draw air through the inlet opening and out the outlet opening;

a grille configured to engage the fan housing, the grille defining a light module opening; and a light module comprising:

a module housing engaged to the grille;

a semitransparent cover coupled to the module housing to define an enclosed space; and a plurality of light emitting elements positioned within the module housing and oriented to emit light toward the semitransparent cover, the plurality of light emitting elements being positioned within the interior space a predetermined minimum distance from an inner surface of the semitransparent cover, the predetermined minimum distance corresponding to about a spacing between two adjacent light emitting elements of the plurality of light emitting elements.

12. The exhaust fan assembly of claim 11, wherein the module housing includes a rear face, and wherein the fan is at least up to about 2 inches from the rear face of the module housing.

13. The exhaust fan assembly of claim 11, wherein the housing further includes at least one mounting feature engagable to a grille of the exhaust fan assembly.

14. The exhaust fan assembly of claim 11, wherein the window portion has an inner surface, and wherein the plurality of light emitting elements are positioned within the interior space the predetermined minimum distance from the inner surface of the window portion.

15. The exhaust fan assembly of claim 14, wherein the semitransparent cover has a sidewall for positioning the inner surface of the window portion the predetermined minimum distance from the plurality of light emitting elements.

16. The exhaust fan assembly of claim 11, wherein the predetermined minimum distance corresponds to about a maximum spacing between adjacent light emitting elements of the plurality of light emitting elements.

17. The exhaust fan assembly of claim 11, wherein the plurality of the light emitting elements are arranged in a planar array.

18. The exhaust fan assembly of claim 11, further comprising:

a power cable connectable to a wall outlet; and a connector cable operably connecting the power cable to the plurality of light emitting elements.

19. The exhaust fan assembly of claim 11, wherein the plurality of light emitting elements comprises a plurality of light emitting diodes.

20. The exhaust fan assembly of claim 11, wherein the predetermined minimum distance corresponds to about a minimum spacing between adjacent light emitting elements of the plurality of light emitting elements.

* * * * *